United States Patent [19]

Weigel et al.

[11] 4,358,311

[45] Nov. 9, 1982

[54] METHOD AND APPARATUS FOR THE SMELTING OF MATERIAL SUCH AS ORE CONCENTRATES

[75] Inventors: Horst Weigel; Gerhard Melcher, both of Cologne, Fed. Rep. of Germany

[73] Assignee: Klöckner-Humboldt-Deutz AG, Fed. Rep. of Germany

[21] Appl. No.: 290,077

[22] Filed: Aug. 4, 1981

Related U.S. Application Data

[63] Continuation-in-part of Ser. No. 152,592, May 23, 1980.

[30] Foreign Application Priority Data

May 31, 1979 [DE] Fed. Rep. of Germany ..... 2922189

[51] Int. Cl.[3] ..... C22B 15/00; F27B 15/00

[52] U.S. Cl. ..... 75/26; 75/74; 75/92; 266/162; 266/172; 266/182

[58] Field of Search ..... 75/72, 92, 26; 266/162, 266/172, 182

[56] References Cited

U.S. PATENT DOCUMENTS 3,222,162 12/1965 Beals et al. ..... 75/74

4,236,916 12/1980 Melcher et al. ..... 75/21

*Primary Examiner*—M. J. Andrews

*Attorney, Agent, or Firm*—Hill, Van Santen, Steadman, Chiara & Simpson

[57] ABSTRACT

A method and apparatus for smelting an ore concentrate or the like wherein the concentrate is first melted in an oxidizing atmosphere and the smelt is aftertreated with reducing gases to recover the metal values. The improvement consists in positioning a plurality of rows of lances in a smelting reactor in the direction of molten metal flow, the spacing between the rows of lances being substantially greater than the spacing between individual lances in each row. The reducing gas is blown with a high kinetic energy through each lance to cause an area of toroidal bath movement to occur where the gases from each lance impinge against the moving smelt. The spacing between the rows of lances is sufficiently large so that a relatively quiescent zone exists between the areas of toroidal bath movement between each of the rows. The molten metal and a relatively metal-free slag are withdrawn separately from the furnace enclosure.

10 Claims, 2 Drawing Figures

METHOD AND APPARATUS FOR THE SMELTING OF MATERIAL SUCH AS ORE CONCENTRATES

REFERENCE TO RELATED APPLICATION

This application is a continuation-in-part of Ser. No. 152,592, filed May 23, 1980.

BACKGROUND OF THE INVENTION

1. Field of the Invention

This invention is in the field of smelting ore concentrates, particularly sulfide type materials wherein the ore concentrate is smelted with relatively pure oxygen in a cyclone smelter, followed by an aftertreatment in which the smelt is reduced to produce the metal as a molten layer with an overlying slag layer, the conditions of aftertreatment being carefully controlled to improve the efficiency of the overall process, and to reduce the amount of metal that is left in the slag.

2. Description of the Prior Art

In German OS No. 2,348,105 there is described a method in which fine-grained sulfur-containing ore concentrates are introduced into a cyclone reactor into which an oxygen-rich gas is blown through a tangentially discharging supply line. The ore concentrate is continuously calcined and melted in the cyclone reactor in the turbulent conditions existing in the reactor. The smelt is collected below the cyclone reactor and consists of a lighter slag phase and a heavier metal phase such as copper matte. The smelt is then metallurgically aftertreated by means of reducing gases which are blown onto the smelt through a lance so that metal oxides which are contained in the slag phase are converted into droplets of metal matte. With such an aftertreatment with reducing gases under these conditions, the lighter slag phase still contains relatively large amounts of metal in admixture with the smelt, so that the two mixed phases are withdrawn to another location where they are subsequently separated from each other by means of a separate centrifuge. Beyond the reduction of the oxides, no other aftertreatment of the melt is carried out.

SUMMARY OF THE INVENTION

The present invention provides a method and apparatus for smelting of ore concentrates, particularly sulfidic ore concentrates, including a melting zone and a reactor for aftertreatment of the smelt. In the reactor, there are a plurality of rows of lances operating under conditions such that slag conditioning is carried out under optimum conditions and material transfer as well as heat transfer are carried out quickly. The process of the present invention is characterized by a high space-time yield and the lighter slag phase and the heavier metal-containing phase no longer need be separated by means of a separate centrifuge.

In accordance with the method of the present invention, the aftertreatment of the smelt is carried out by blowing reducing gases through a plurality of rows of spaced lances under conditions sufficient to form relatively fluid slag and heavier metal-containing phases which can be conveniently withdrawn from separate discharge areas in the furnace housing.

In accordance with the present method, the gases are continuously blown onto the smelt through a plurality of top blowing lances in the form of concentrated streams of high kinetic energy. These high energy streams are continuously introduced to the phase boundary layer between the slag and the smelt and thoroughly mix the two so that heat transfer and material transfer proceed in the reactor at high velocities with the result that the lighter slag phase and the heavier metal containing phase can be separately withdrawn from the reactor quickly without the necessity of providing a separate centrifuge.

In a preferred form of the present invention, the reduction gases which are blown onto the smelt consist of a hydrocarbon fuel gas such as methane, ethane or preferably propane in admixture with oxygen in less than stoichiometric amounts necessary for complete combustion so that the reduction reaction can be precisely controlled in terms of reduction potential to achieve a specific, selective degree of refining. For example, the conditions can be selected so that there is little or no reduction of any iron oxides present. Furthermore, the conditions can also be adjusted to volatilize off rare metal oxides such as germanium oxides and other rare metal oxides.

The spacing between the rows of lances is correlated with the spacing between the individual lances in a row so as to produce highly turbulent, toroidal reaction zones immediately beneath each lance, which zones are separated from similar reaction zones in the next row of lances by a relatively quiescent liquid zone which prevents reverse mixing of slag constituents into the metal being refined in a previous row of lances. Furthermore, the kinetic energy of the reducing gases is adjusted so that the toroidal-shaped reaction areas beneath the lances are contiguous with each other or actually overlap slightly with each other. Each row of lances thus provides a separate reaction system, and the smelt slowly flowing under the lances is continuously reduced in a step-by-step reaction when the lances are fed with reduction gases having reduction potentials which increase from one row of lances to the next. In other words, the oxidation potential of the fuel gas-oxygen mixture fed to the lances decreases from one row of lances to the next so that the last row of lances involves the highest reduction potential and, of course, the lowest oxidation potential.

The apparatus of the present invention includes a common furnace housing for smelting and reaction zones. A smelting cyclone is located within the smelting zone and is provided with means for introducing an ore concentrate therein. Means are also provided for introducing oxygen gas into the smelting cyclone. The furnace housing has a floor on which metal melted in the smelting cyclone collects, the floor being shaped to permit flow of molten metal and slag to occur from below the smelting cyclone into a reaction zone located in the furnace housing. In the smelting zone, a plurality of rows of lances are positioned with the spacing between individual lances in a row being substantially smaller than the spacings between rows. Means are provided for introducing reducing gases at high kinetic energy into each of the lances for impingement against the melt flowing therebeneath. Means are provided for withdrawing molten slag from the furnace housing and for separately withdrawing molten metal therefrom. In a peferred embodiment of the invention, the spacings between rows of lances are at least twice the spacing between individual lances in a row.

DESCRIPTION OF THE PREFERRED EMBODIMENTS

Figure 1:
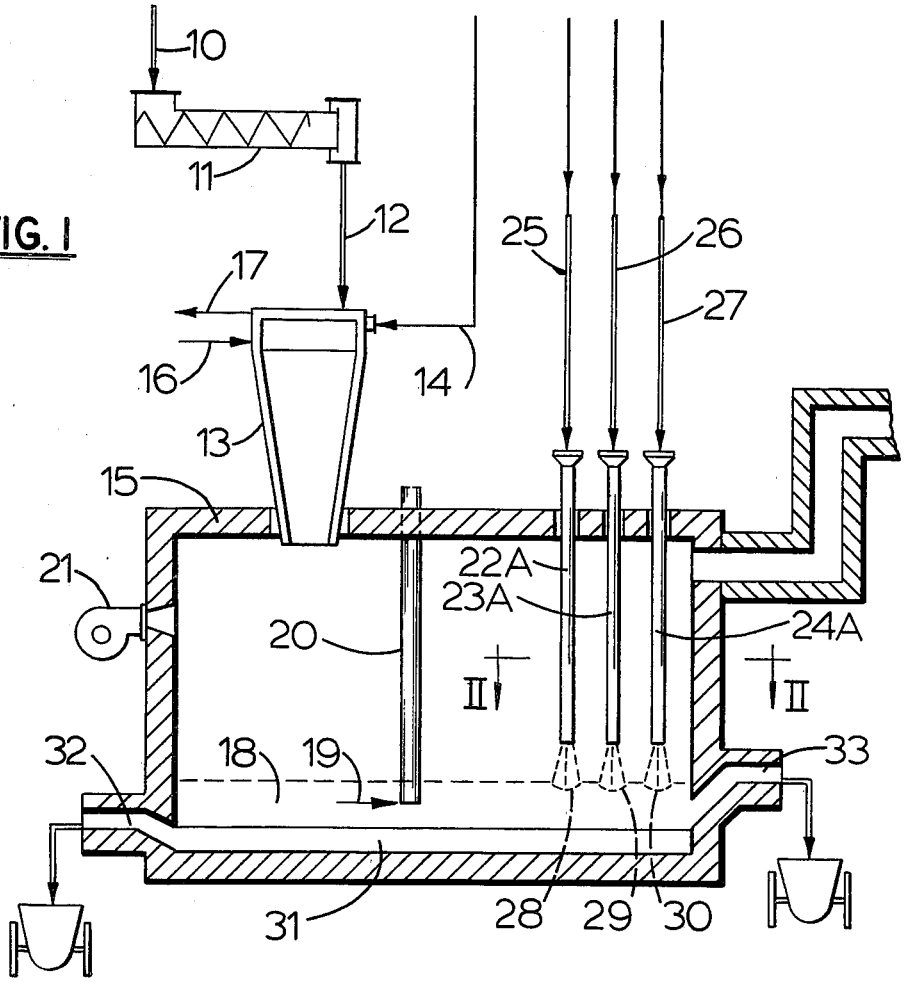
FIG. 1 is a schematic view illustrating a furnace assembly which can be used for the purposes of the present invention.

The invention, together with additional advantages and features are explained in greater detail in the embodiments of the invention schematically illustrated in the drawings.

FIG. 1 illustrates a pyrometallurgical furnace installation for smelting fine-grained sulfidic copper ore concentrate which is supplied together with other reactants by means of an inlet 10 to a screw conveyor 11. The conveyor 11 supplies the materials through an inlet line 12 into the top of a melting cyclone 13. A stream of technically pure oxygen is admitted tangentially of the cyclone reactor 13 through a line 14. The finely divided feed material is calcined and melted in the smelting cyclone 13, whereupon the molten material drops into a furnace defined by a furnace housing 15. The melting cyclone 13 can be cooled by means of connecting the same to a water inlet line 16, and the cooling water is withdrawn by means of a return line 17.

The temperatures in the smelting cyclone 13 may vary from about 1500° to 2400° C., utilizing technically pure oxygen as the oxidizing gas.

The raw material is heated very rapidly to these high temperatures in a fraction of a second while it is still in suspension or in a highly turbulent state. The combustion of the sulfur and other oxidizable components in the oxygen atmosphere usually supplies sufficient heat in order to permit the calcining and melting processes to proceed autogenously.

A smelt 18 collects below the smelting cyclone 13 along the floor of the furnace housing 15, the smelt flowing in the direction of the arrow 19 by virtue of a sloping floor in the furnace enclosure. The smelt thus passes from the smelting zone to the reaction zone, and may pass underneath a partition 20 which is immersed into the smelt 18 to separate the oxidizing atmosphere in the smelting zone from the reducing atmosphere prevailing in the aftertreating, reaction zone. To this end, the smelting zone can be provided with its own waste gas exhaust line (not shown).

The furnace may also be provided with an additional burner 21 in one wall of the furnace housing 15 to supply hot gases for compensating for heat losses.

Figure 2:
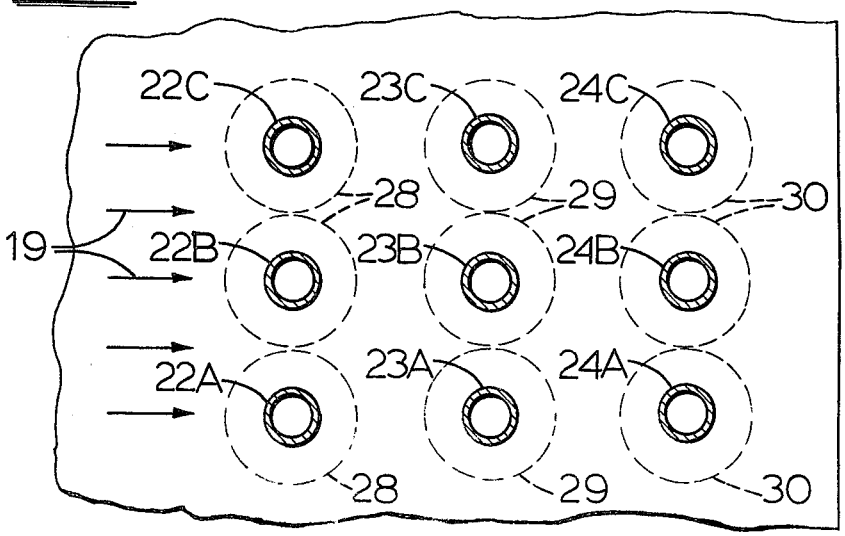
FIG. 2 is a view taken substantially along the line II—Ii of FIG. 1 in somewhat enlarged form.

In the reaction zone, there is a plurality of rows of lances, the first row of which contains lances 22A, 22B and 22C, the second row containing lances 23A, 23B and 23C, and the third row in the direction of metal movement consisting of lances 24A, 24B and 24C. It is important to space the lances with respect to each row, and the spacing between rows, in order to secure the best results. The lances are fed with reducing gases through inlets 25, 26 and 27, respectively. These inlets deliver a mixture of a hydrocarbon fuel gas such as propane in admixture with small amounts of oxygen, the amount of oxygen being insufficient to provide for complete combustion of the hydrocarbon fuel gas. The amount of oxygen progressively decreases from inlet 25 through inlet 26 through inlet 27. In other words, the reducing potential increases in the direction of metal movement, and the oxidation potential, of course, decreases in that direction. The oxygen partial pressure in the gas can be as low as $10^{-12}$ atmospheres in the final lance, and is typically less than $10^{-5}$ atmosphere in all the lances. The high kinetic energy in the confined streams causes the surface of the melt to be indented somewhat as indicated in FIG. 1 by depressions 28, 29 and 30, respectively. As best seen in FIG. 2, these depressions take the form of a toroidal-shaped bath movement indicated in dotted lines, and this movement penetrates the molten bath to a specific bath depth. This assures a thorough agitation at least in the slag phase so that the processes of heat and material transmission take place with high velocities. As seen in FIG. 2, the pressure of the fuel gases being fed through the lances can be adjusted so that the toroidal depressions 28 are just in contact with each other, or they can actually overlap.

One of the important elements of the present invention is the proper spacing to be achieved between the rows of lances. We have found, for example, that it is important that the lances in a given row be spaced by a distance at least twice that by which the individual lances are separated in a given row. For example, the lances 23A, 23B, and 23C are spaced by a distance from the lances 22A, 22B, and 22C which is at least twice the spacing between the individual lances 22A, 22B, and 22C. This spacing provides a relatively quiescent zone between the rows of lances which avoids reverse mixing or backward mixing between the toroidal depressions 28, 29, and 30, respectively. Consequently, slag bath particles which have been removed in the first row of lances are not returned back to the vicinity of the reaction zone in that first row. Consequently, it is possible to substantially reduce the amount of copper in the slag phase, with a copper content of 0.5% or less in the slag phase being readily achievable.

As a specific example, we can use a lance spacing of about 0.5 meters between the lances in a given row, and a spacing between rows of about 1.15 meters.

The heavier, metal-containing phase 31 is withdrawn through an outlet 32 on one side of the furance assembly, the outlet 32 being lower than an outlet 33 on the opposite side of the furnace which is used to discharge slag off the floor of the furnace beyond the reaction zone.

The method and apparatus of the present invention provide a very high reduction efficiency for treating sulfidic type ore concentrates, particularly in the production of copper. The reaction conditions can be very carefully controlled by controlling the gas pressure in the reaction zone, as well as the gas composition. Consequently, it is possible with the process and apparatus of the present invention to achieve selective reducing of the various metal oxides in the ore concentrate, with volatilization of rare metal oxides. The careful reaction conditions achieved in the process of the present invention makes it unnecessary to aftertreat the slag for the recovery of metal.

It should be evident that various modifications can be made to the described embodiments without departing from the scope of the present invention.

We claim as our invention:

1. A method for smelting an ore concentrate or the like wherein said concentrate is first melted in an oxidizing atmosphere and the smelt is aftertreated with reducing gases to recover the metal values wherein the improvement comprises:

positioning a plurality of rows of lances in a smelting reactor in the direction of molten metal flow, the spacing between rows of lances being substantially greater than the spacing between individual lances in each row, blowing a reducing gas through each lance with sufficiently high kinetic energy to cause an area of toroidal bath movement to occur where the gases from each lance impinge against the moving smelt, the spacing between rows of lances being sufficiently large so that a relatively quiescent zone exists between the areas of toroidal bath movement between each of said rows, and separately withdrawing a slag phase and a metal-containing phase from said smelting reactor.

2. A method according to claim 1 in which:

the lances in each row are spaced sufficiently close together so that said areas of toroidal bath movement between adjacent lances in a row overlap.

3. A method according to claim 1 which includes the step of:

passing reducing gases of progressively increasing reduction potential into the rows of lances in the direction of molten metal flow.

4. A method according to claim 1 in which:

said lances in adjacent rows are spaced by a distance at least two times as great as the spacing between adjacent lances in a given row.

5. A method according to claim 3 in which:

said reducing gases are mixtures of a hydrocarbon gas and oxygen containing less oxygen than would be stoichiometrically required for complete combustion of said hydrocarbon gas.

6. A method according to claim 5 in which:

said hydrocarbon gas is propane.

7. A method according to claim 5 in which:

the partial pressure of oxygen in said reducing gas is less than $10^{-5}$ atmospheres.

8. An apparatus for smelting an ore concentrate or the like comprising:

a furnace housing, a smelting cyclone located in said housing, means for introducing an ore conentrate into said smelting cyclone, means for introducing oxygen gas into said smelting cyclone, said furnace housing having a floor on which metal melted in said smelting cyclone collects, said floor being shaped to permit flow of molten metal and slag to occur from below said smelting cyclone into a reaction zone located in said furnace housing, a plurality of rows of lances positioned in said reaction zone, the spacing between individual lances in a row being substantially smaller than the spacings between rows, means for introducing reducing gases at high kinetic energy into each of said lances of impingement against the melt flowing therebeneath, means for withdrawing molten slag from said furnace housing, and means for separately withdrawing molten metal from said furnace housing.

9. An apparatus according to claim 8 in which:

the spacing between rows of lances is sufficient to create quiescent zones of melt intermediate said rows of lances.

10. An apparatus according to claim 8 in which:

the spacings between rows of lances are at least twice the spacing between the individual lances in a row.

* * * * *